US008033034B2

(12) United States Patent
Jarosik

(10) Patent No.: US 8,033,034 B2
(45) Date of Patent: Oct. 11, 2011

(54) SHOE WITH DETACHABLE AND FLEXIBLE HEEL STRAP

(75) Inventor: Gary R. Jarosik, Chicago, IL (US)

(73) Assignee: Sears Brands, LLC, Hoffman Estates, IL (US)

( * ) Notice: Subject to any disclaimer, the term of this patent is extended or adjusted under 35 U.S.C. 154(b) by 647 days.

(21) Appl. No.: 11/809,825

(22) Filed: Jun. 1, 2007

(65) Prior Publication Data

US 2008/0295359 A1 Dec. 4, 2008

(51) Int. Cl.
*A43B 3/12* (2006.01)
*A43C 11/00* (2006.01)

(52) U.S. Cl. ..... 36/50.1; 36/11.5

(58) Field of Classification Search ..... 36/50.1, 36/51, 105, 110, 102
See application file for complete search history.

(56) References Cited

U.S. PATENT DOCUMENTS 4,541,186 A * 9/1985 Mulvihill ..... 36/114
4,773,170 A * 9/1988 Moore et al. ..... 36/110
4,825,563 A * 5/1989 Strongwater ..... 36/73
5,014,448 A * 5/1991 Perrone ..... 36/110
5,452,527 A * 9/1995 Gaylord, Jr. ..... 36/110
6,237,250 B1 * 5/2001 Aguerre ..... 36/11.5
6,256,906 B1 * 7/2001 Matis et al. ..... 36/11.5
6,993,858 B2 2/2006 Seamans
D517,788 S 3/2006 Seamans
D517,789 S 3/2006 Seamans
D517,790 S 3/2006 Seamans
D525,419 S 7/2006 Seamans
7,146,751 B2 12/2006 Seamans
D535,088 S 1/2007 Seamans
D543,341 S 5/2007 Seamans
7,334,354 B2 * 2/2008 Foxen et al. ..... 36/89
D584,032 S * 1/2009 Jarosik ..... D2/896
2001/0001350 A1 * 5/2001 Aguerre ..... 36/31
2006/0048407 A1 3/2006 Seamans
2007/0266596 A1 * 11/2007 Mann ..... 36/50.1

* cited by examiner

*Primary Examiner* — Jila Mohandesi
(74) *Attorney, Agent, or Firm* — Greenberg Traurig, LLP

(57) ABSTRACT

A shoe manufactured from a moldable foam material having a heel strap formed of a flexible and elastic material. The heel strap has a first end which is fixedly attached to an interior outer side of an upper portion of shoe. The heel strap also has a second end which is removeably attachable to an exterior outer side of the upper portion of the shoe though use of a Velcro loop arrangement and a cooperating Velcro hook arrangement which are attached each to one of the exterior outer side of the upper portion of the shoe and the second end of the heel strap.

14 Claims, 8 Drawing Sheets

SHOE WITH DETACHABLE AND FLEXIBLE HEEL STRAP

BACKGROUND

Shoes, particularly shoes molded from a lofted or foam material, are known in the art. By way of example, U.S. Pat. Nos. D543,341, D525,419, D517,790, D517,789, D517788, 7,146,751, and 6,993,858 as well as US Published Application No. 2006/0048407 illustrate and describe shoes that are representative of the current state of the art. Each of these references is hereby incorporated by reference in its entirety.

SUMMARY

The following describes and illustrates a shoe, particularly a shoe molded from a lofted foam material, having a detachable and flexible heel strap. A better understanding of the objects, advantages, features, properties and relationships of the shoe will be obtained from the following detailed description and accompanying drawings which set forth an illustrative embodiment which is indicative of the various ways in which the principles of the shoe described hereinafter may be employed.

BRIEF DESCRIPTION OF THE DRAWINGS

For a better understanding of the shoe reference may be had to the following drawings in which.

DETAILED DESCRIPTION

Figure 1:
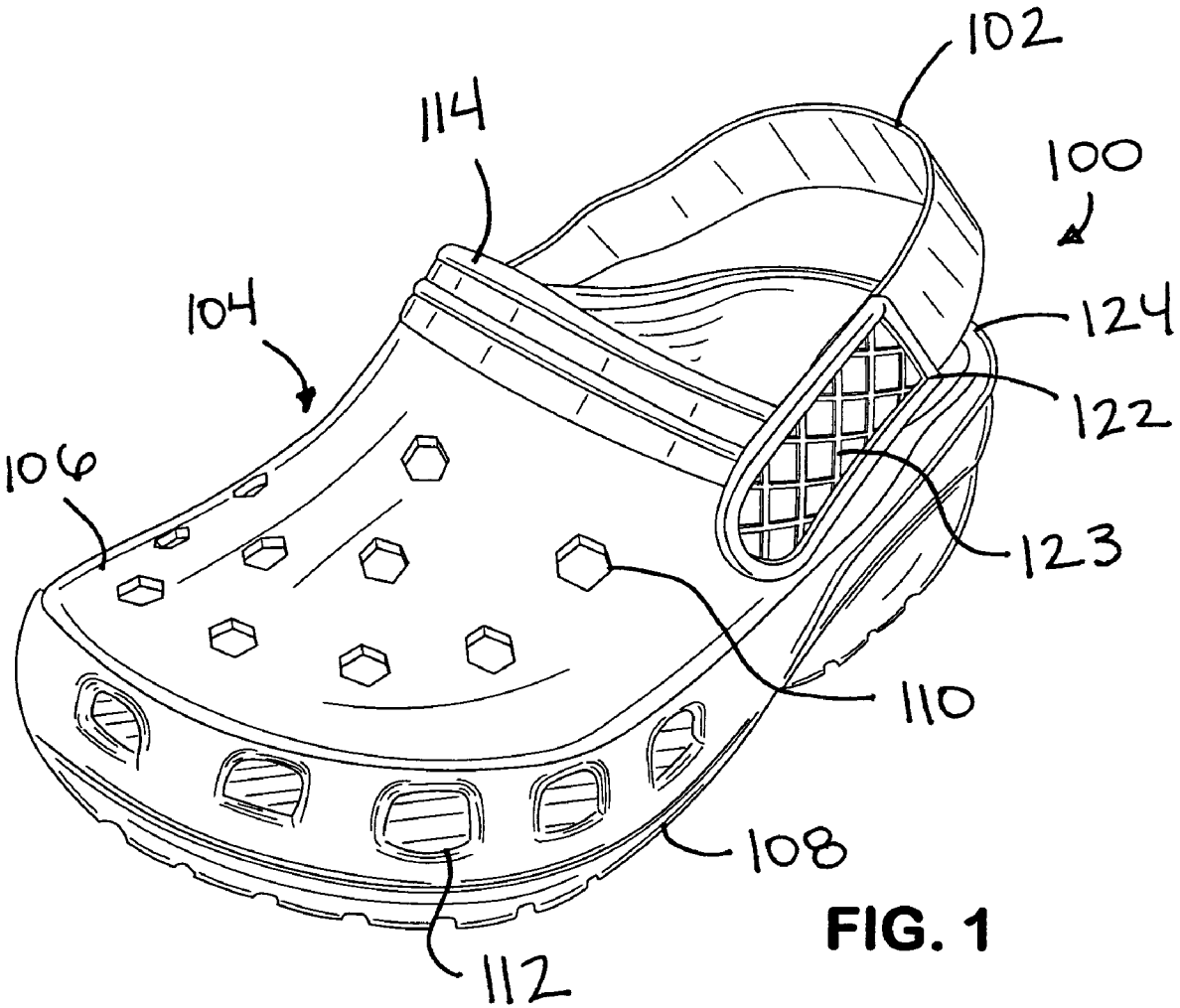
FIG. 1 is a front perspective view showing the subject shoe with the flexible heel strap attached.
Figure 2:
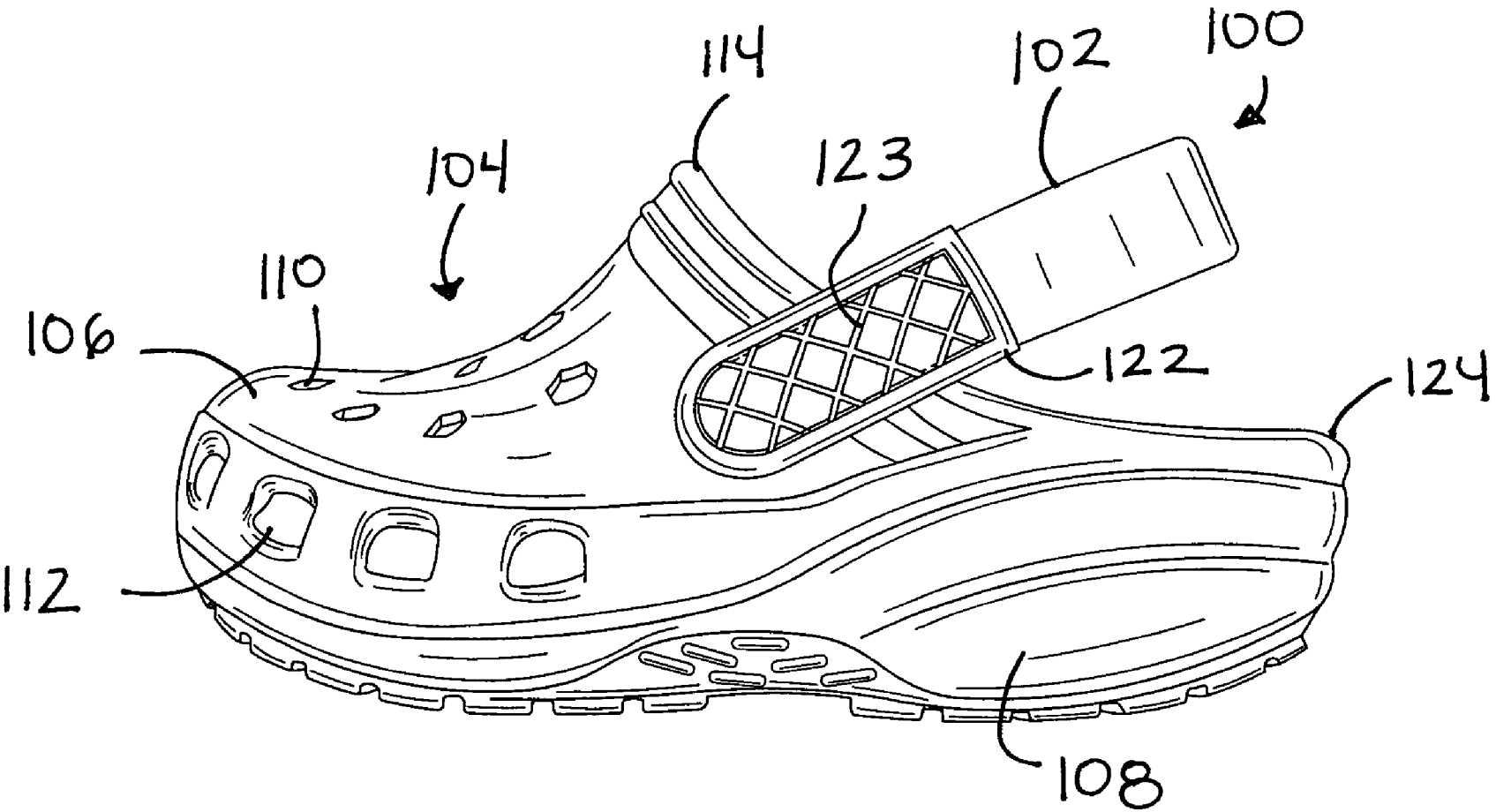
FIG. 2 is an outer side view of the shoe of FIG. 1.
Figure 3:
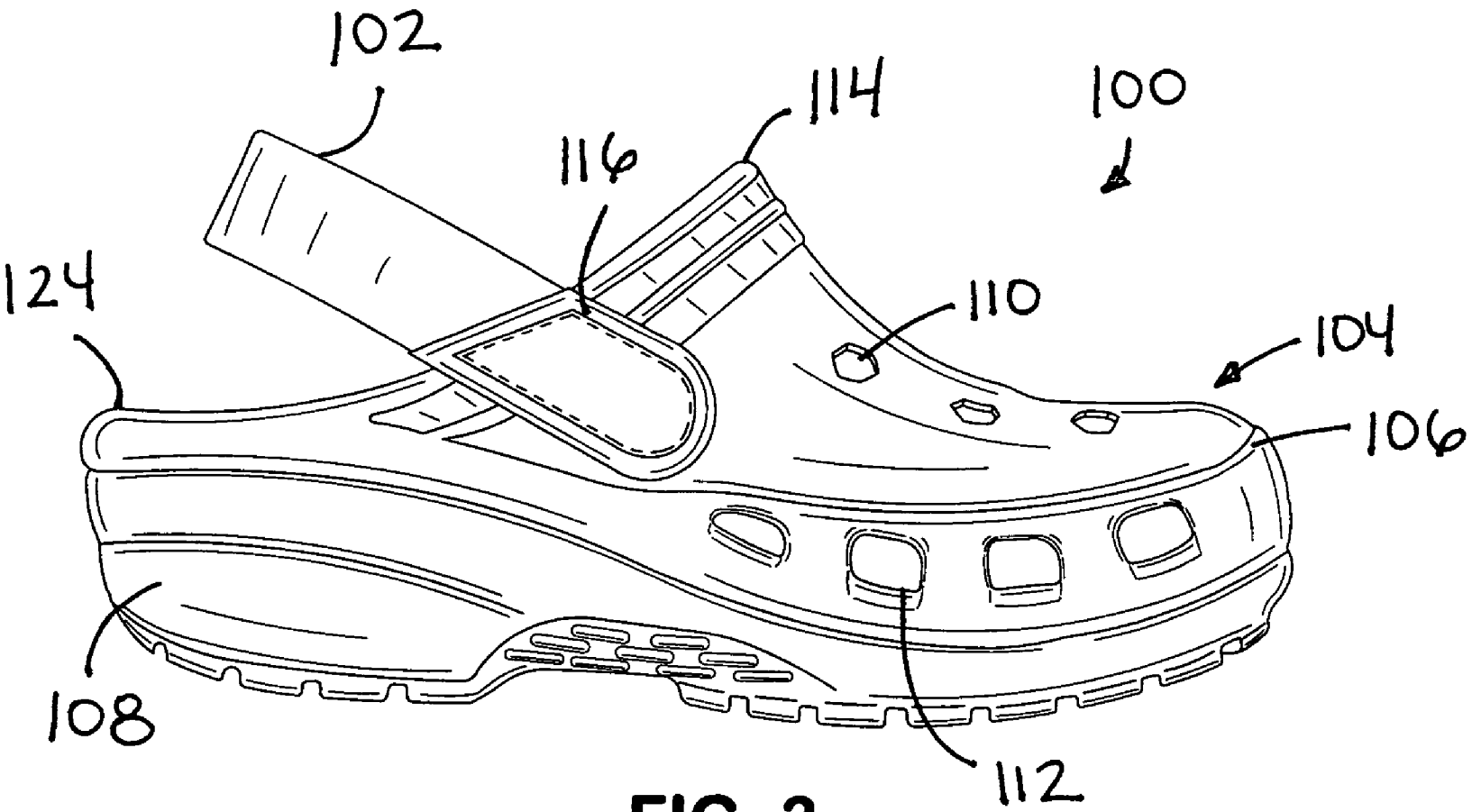
FIG. 3 is an inner side view of the shoe of FIG. 1.
Figure 4:
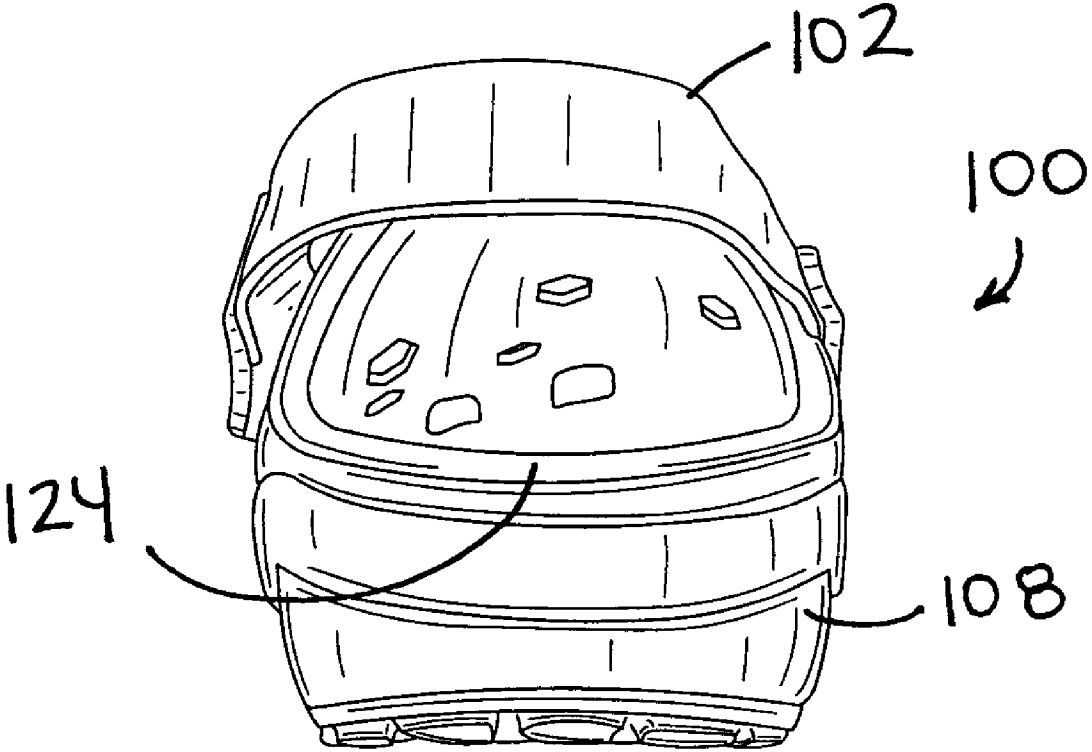
FIG. 4 is a back view of the shoe of FIG. 1.
Figure 5:
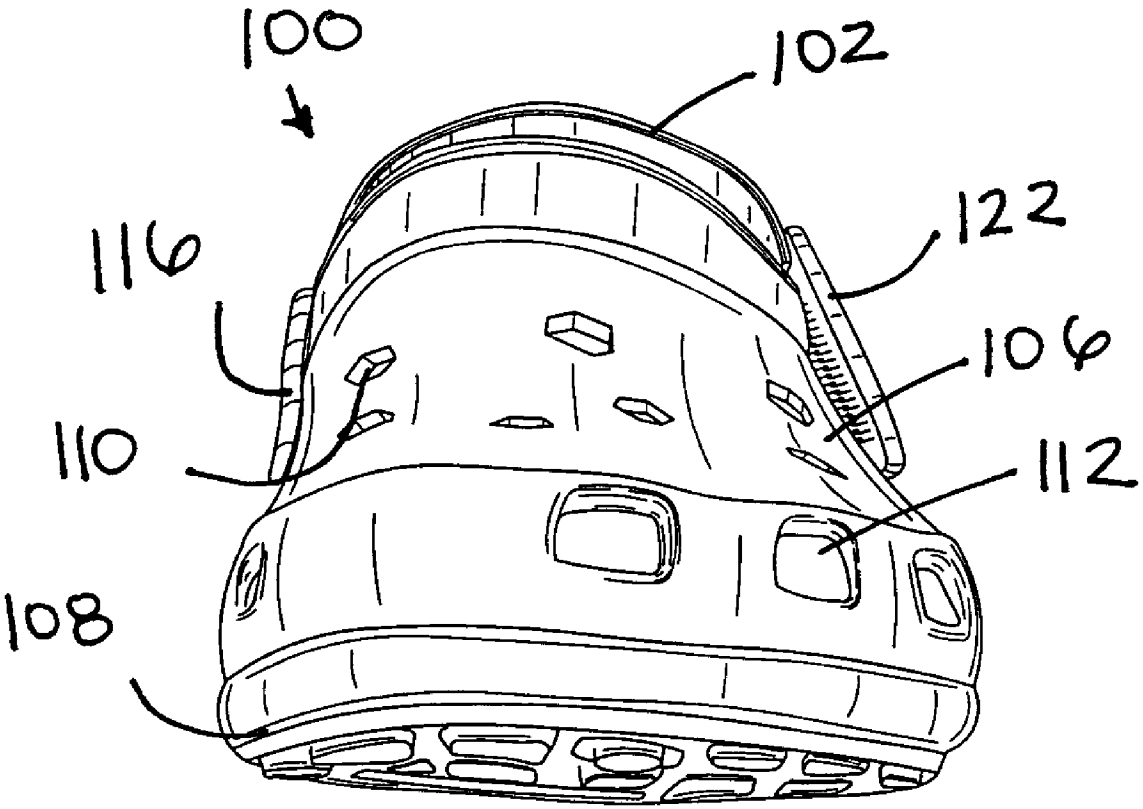
FIG. 5 is a front view of the shoe of FIG. 1.
Figure 6:
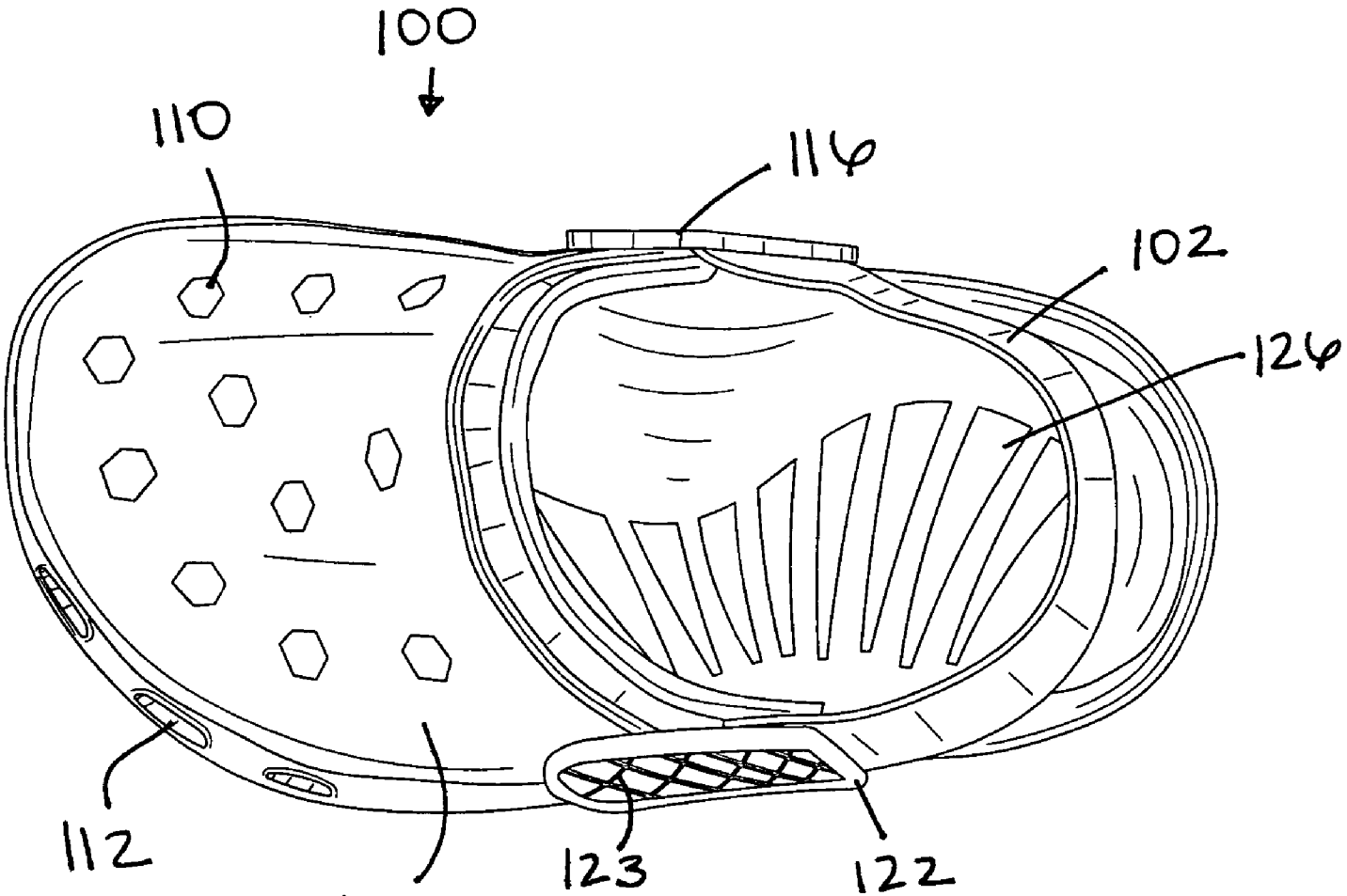
FIG. 6 is a top view of the shoe of FIG. 1.
Figure 7:
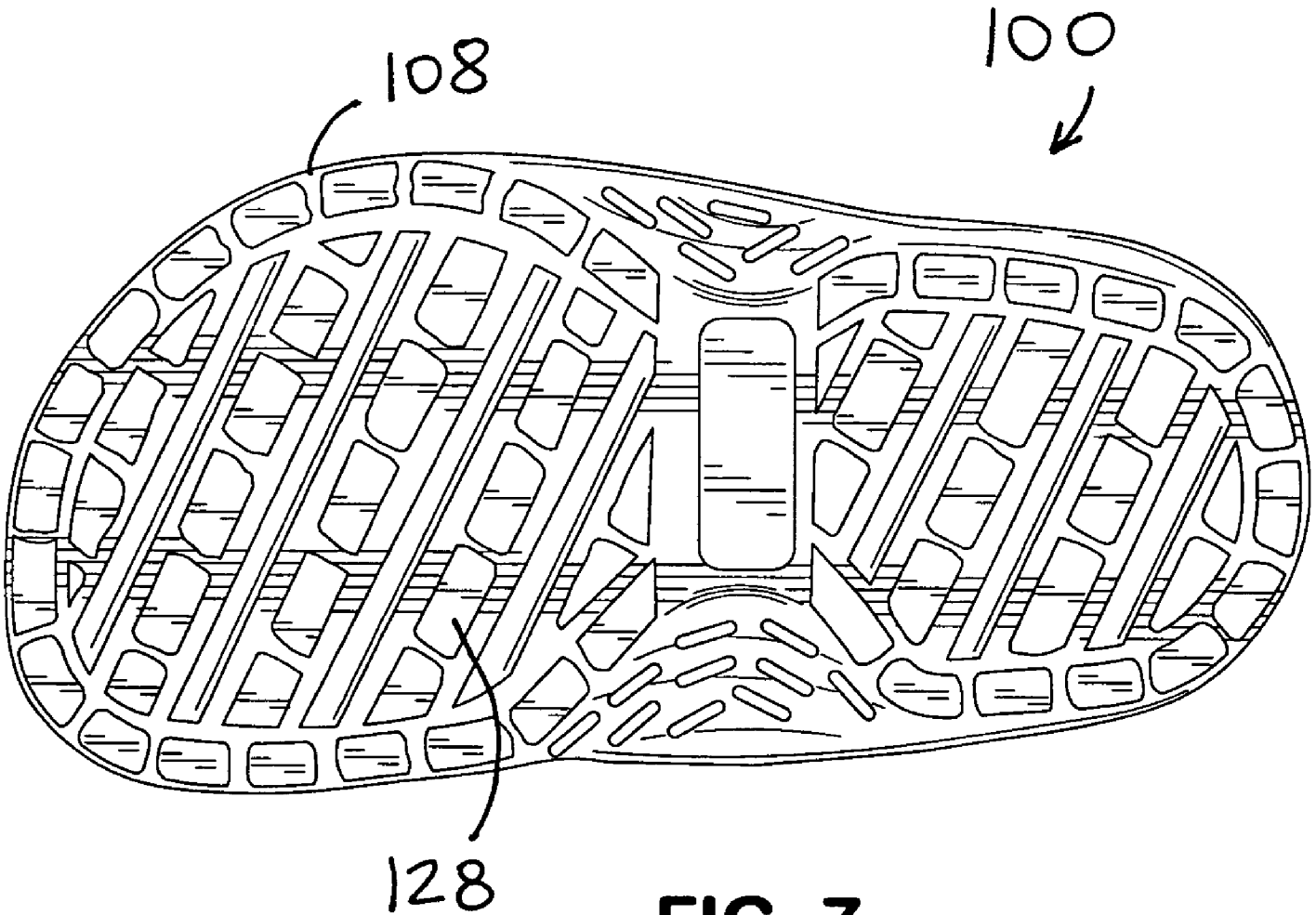
FIG. 7 is bottom view of the shoe of FIG. 1.
Figure 8:
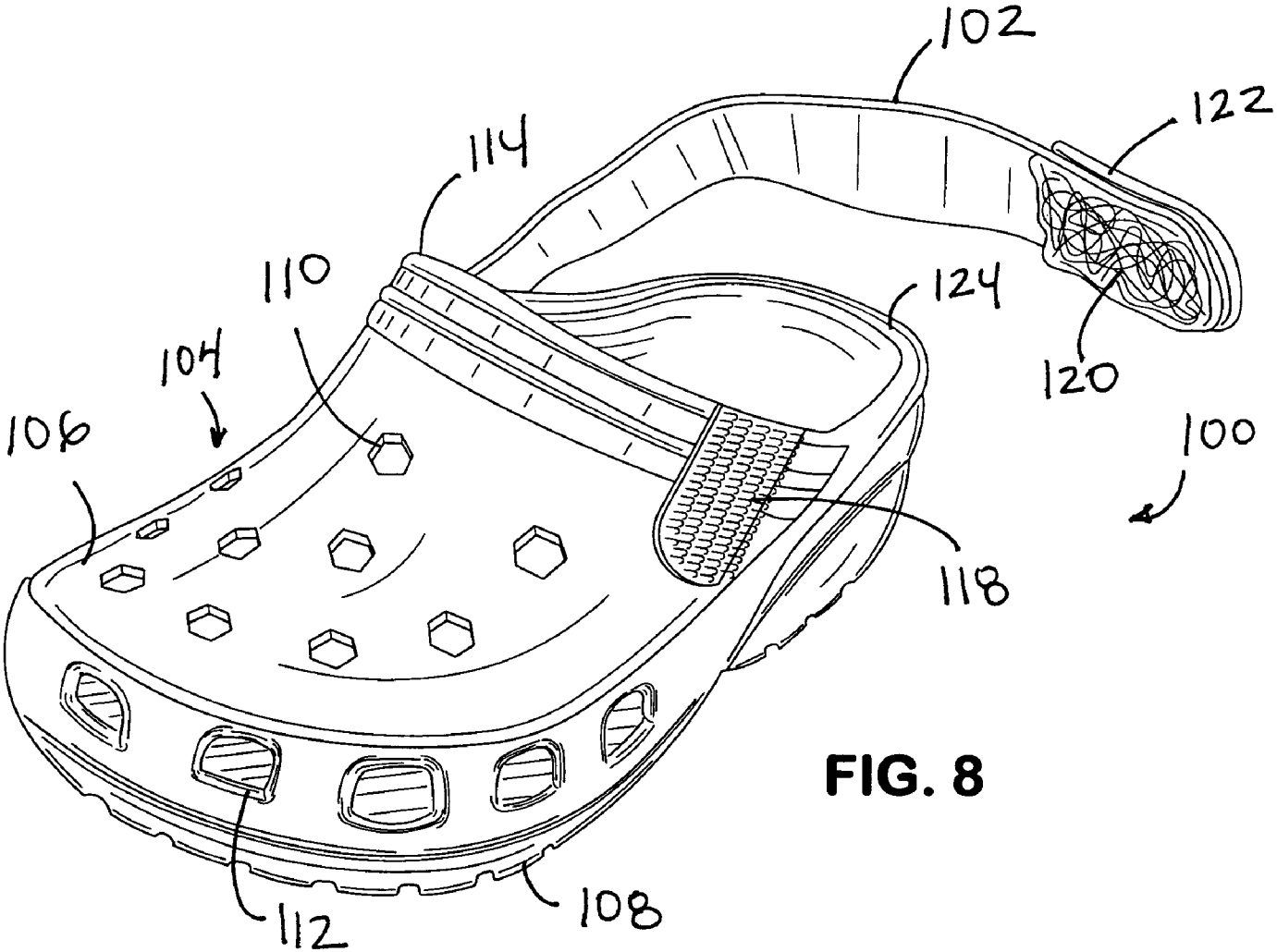
FIG. 8 is a front perspective view of the shoe of FIG. 1 further showing the flexible heel strap having an end portion detached from the shoe.

With reference to the figures, a shoe 100 having a detachable and flexible heel strap 102 is hereinafter described. As illustrated, the shoe 100 includes a base section 104 to which at least one end of the flexible heel strap 102 is detachably attached as will be described in greater detail below. The flexible heel strap 102 may be formed of an elastic, textile material, for example of the type typically used in the construction of elastic, expandable waistbands.

As further illustrated, the base section 104 of shoe 100 includes an upper portion 106 and a sole portion 108 and the upper portion 106 and the sole portion 108 may be integrally molded as a single piece using a lofted or foam material or molded as separate pieces and thereafter attached. Since the process for forming a shoe from lofted or foam material is thoroughly described in incorporated U.S. Pat. No. 6,993,858 it will not be repeated herein for the sake of brevity.

The upper portion 106 may include one or more top surface ventilating openings 110 shown, by way of example, has having a hexagonal shape. The ventilating openings 110 may be formed in the top surface of the upper portion 106 during the molding of the shoe 100 or can be formed after molding of the shoe 100, for example, by using an appropriately shaped punch. Additional ventilating openings 112, shown, by way of example, has having a rectangular shape, may be provided to the lower side surfaces of the upper portion 106 of the shoe 100. Again, the ventilating openings 112 may be formed during the molding of the shoe 100 or can be formed after molding using an appropriate punching tool.

As still further illustrated, the shoe 100 includes a toe region that is intended to surround the toes of a human foot inserted into the base section 104. The toe region of the shoe 100 tapers from the inner area of base section 104 to the outer area of the base section 104 such that it generally follows the contour of human foot toes. In other embodiments the toe region of the shoe 100 may be provided with a squared shape or a rounded shape that does not exhibit tapering. The toe region of the shoe 100 transitions to an in step region of the shoe 100 that rises towards an upper opening perimeter section 114. As will be appreciated, when the shoe 100 is worn, the illustrated upper opening perimeter section 114 of the exemplary shoe 100 would contact an area of the human foot in front of and below the ankle.

As yet further illustrated, the upper opening perimeter section 114 of the shoe 100 extends from a first heel strap attachment position to a second heel strap attachment position. Preferably, the first heel strap attachment position is located on the interior outer side of the shoe 100 while the second heel strap attachment position is located on the opposite, exterior outer side of the shoe 100. At the first heel strap attachment position a first end of the heel strap 102 is preferably fixedly attached to the shoe base section 104. By way of example, the first end of the heel strap 102 may be fixedly attached to the base section 104 by being sewn to the base section 104. More particularly, the first end of the heel strap 102 may be positioned intermediate the base section 104 and a further piece of attachment material 116 formed, for example, from plastic, leather, or the like type of durable material, whereupon the attachment material 116 and underlying first end of the heel strap 102 are simultaneously sewn to the base section 104. In further embodiments, the first end of the heel strap 102, with or without the attachment material 116, may be riveted to, stapled to, or otherwise attached to the base section 104. Yet further, in some embodiments it may be desirable to attach the first end of the heel strap 102 to the base section 104 such that the heel strap 102 is capable of being rotated about its point of attachment to the base section 104.

At the second heel strap attachment position a second end of the heel strap 102 is removeably attachable to the shoe base section 104. The second end of the heel strap 102 may be removeably attachable to the base section 104 by providing each of the base section 104 and the second end of the heel strap 102 with one half of a disengagable attachment device. For example, the base section 104 may be provided with Velcro hook material 118 while the second end of the heel strap 102 may be provided with complimentary Velcro loop material 120 or vice versa. It will be appreciated that the disengageable attachment device may also be a snap in/snap out attachment system or the like type of device capable of providing both attachment and non-destructive detachment of the second end of the heel strap 102 with the base section 104. It will be additionally appreciated that the first end of the heel strap 102 may be attachable to the base section 104 using a similar disengageable attachment mechanism to thereby allow for complete removal of the heel strap 102 from the shoe 100 if so desired.

The Velcro hook material 118 may be attached to the base section 104 using any appropriate means, such as by being sewn to the base section 104, by being glued to the base section 104, being molded into the base section 104, or the like without limitation. Similarly, the Velcro loop material 120 may be attached to the second end of the heel strap 102 using any appropriate means, such as by being sewn to the heel strap 102, by being glued to the heel strap 102, or the like without limitation. In the illustrated exemplary shoe 100, on one side of the second end of the heel strap 102 is positioned the Velcro loop material 120 while on the opposite side of the second end of the heel strap 102 is positioned attachment material 122 of plastic, leather, or the like type of durable material, with the Velcro loop material 120 then being simultaneously sewn to the attachment material 122 and the intermediately positioned heel strap 102. The outer face of the attachment material 122 may also be provided with a gripping surface such as provided by the illustrated outwardly extending latticework 123.

Turning now to the sole portion 108, the sole portion includes a heel section in which would be positioned the heel of a wearer of the shoe 100. In the illustrated example, the heel section of the sole portion 108 includes a rear sole perimeter section 124 which is raised with respect to the shoe insole, i.e., the upper area of the sole portion 108 that will be in contact with the bottom part of the foot of a wearer of the shoe 100. As will be appreciated, the raised rear sole perimeter section provides some support to the heel and helps maintain shoe 100 in position on the foot of a wearer. In other embodiments, a rear sole perimeter section 124 need not be provided. In addition, the shoe insole may be provided with a raised pattern 126 throughout the surface where the bottom of the foot is to be positioned. The shoe outsole, i.e., the area that will be in contact with the ground, may likewise be provided with a pattern of treads 128.

While a specific embodiment of the invention has been described in detail, it will be appreciated by those skilled in the art that various modifications and alternatives to those details could be developed in light of the overall teachings of the disclosure. Accordingly, the particular arrangement disclosed is meant to be illustrative only and not limiting as to the scope of the invention which is to be given the full breadth of the appended claims and any equivalents thereof.

What is claimed is:

1. A shoe, comprising:

a base section including an upper portion and a sole portion formed as a single part manufactured from a moldable foam material; and a heel strap formed of a flexible and elastic textile material, the heel strap having a first end which is non-rotatably and fixedly attached to an interior outer side of the upper portion of the base section with the heel strap being arranged to extend from the interior outer side of the upper portion of the base section in a direction towards a heel portion of the shoe and a second end which is removeably attachable to an exterior outer side of the upper portion of the base section;

wherein a fabric loop arrangement and a cooperating plastic hook arrangement are attached each to one of the exterior outer side of the base section and the second end of the heel strap.

2. The shoe as recited in claim 1, wherein the first end of the heel strap is sewn to the interior outer side of the upper portion of the base section.

3. The shoe as recited in claim 2, comprising an attachment member wherein the attachment member is sewn to the interior outer side of the upper portion of the base section with the first end of the heel strap being disposed between the attachment member and the interior outer side of the upper portion with the heel strap extending from between the attachment member and the interior outer side of the upper portion in the direction towards the heel portion of the shoe.

4. The shoe as recited in claim 3, wherein the attachment member comprises a plastic material.

5. The shoe as recited in claim 2, wherein the fabric hook arrangement is attached to the exterior outer side of the upper portion of the base section and the plastic loop arrangement is attached to the second end of the heel strap.

6. The shoe as recited in claim 5, wherein the fabric hook arrangement is glued to the exterior outer side of the upper portion of the base section.

7. The shoe as recited in claim 5, wherein the fabric loop arrangement is sewn to an interior surface of the second end of the heel strap.

8. The shoe as recited in claim 7, comprising an attachment member wherein the attachment member is sewn to the fabric loop arrangement with the second end of the heel strap being disposed between the attachment member and the fabric loop arrangement.

9. The shoe as recited in claim 8, wherein the attachment member comprises a plastic material.

10. The shoe as recited in claim 9, wherein the attachment member comprises a gripping surface.

11. The shoe as recited in claim 10, wherein the gripping surface comprises an outwardly facing latticework.

12. A shoe, comprising:

a base section including an upper portion and a sole portion formed as a single part manufactured from a moldable foam material;

a heel strap formed of a flexible and elastic textile material having a first end and a second end;

a first attachment member disposed over the first end of the heel strap;

a second attachment member disposed over an outer surface of the second end of the heel strap;

a fabric loop member disposed over an interior surface of the second end of the heel strap opposite the second attachment member; and a plastic hook member cooperable with the fabric loop member attached town exterior outer side of the upper portion of the base section;

wherein the first attachment member and the first end of the heel strap are non-rotatably and fixedly attached by being sewn to an interior outer side of the upper portion of the base section and the second attachment member is fixedly attached by being sewn to the second end of the heel strap and the fabric loop member and wherein the heel strap extends from between the first attachment member and the interior outer side of the upper portion in a direction towards a heel portion of the shoe.

13. The shoe as recited in claim 12, wherein the second attachment member comprises a gripping surface.

14. The shoe as recited in claim 13, wherein the gripping surface comprises an outwardly facing latticework.

* * * * *